US009976418B2

(12) United States Patent
Sollami

(10) Patent No.: US 9,976,418 B2
(45) Date of Patent: May 22, 2018

(54) BIT/HOLDER WITH ENLARGED BALLISTIC TIP INSERT

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 304 days.

(21) Appl. No.: 14/676,364

(22) Filed: Apr. 1, 2015

(65) Prior Publication Data

US 2015/0285074 A1 Oct. 8, 2015

Related U.S. Application Data

(60) Provisional application No. 61/974,064, filed on Apr. 2, 2014.

(51) Int. Cl.
*E21C 35/183* (2006.01)
*E21C 35/18* (2006.01)

(52) U.S. Cl.
CPC .... *E21C 35/183* (2013.01); *E21C 2035/1803* (2013.01); *E21C 2035/1813* (2013.01); *E21C 2035/1816* (2013.01)

(58) Field of Classification Search
CPC ..... E21C 2035/1803; E21C 2035/1809; E21C 2035/1813; E21C 35/18; E21C 2035/1806; E21C 2035/1816; E21C 35/183; E21B 10/485; E21B 2010/561–2010/565; E21B 10/46; E21B 10/48; E21B 10/50–10/56; E21B 10/567–10/58; E21B 2010/566
See application file for complete search history.

(56) References Cited

U.S. PATENT DOCUMENTS

| | | | | |
|---|---|---|---|---|
| 3,397,012 | A | 8/1968 | Krekeler | |
| 3,519,309 | A | 7/1970 | Engle | |
| 3,865,437 | A | 2/1975 | Crosby | |
| 4,084,856 | A | 4/1978 | Emmerich | |
| 4,310,939 | A | 1/1982 | Iijima | |
| 4,453,775 | A | 6/1984 | Clemmow | |
| 4,478,298 | A | 10/1984 | Hake | |
| 4,489,986 | A | 12/1984 | Dziak | |
| 4,525,178 | A | 6/1985 | Hall | |
| 4,561,698 | A | 12/1985 | Beebe | |
| 4,570,726 | A | 2/1986 | Hall | |
| 4,604,106 | A | 8/1986 | Hall | |
| 4,694,918 | A | 9/1987 | Hall | |
| 4,811,801 | A * | 3/1989 | Salesky | B22F 7/06 175/374 |
| 4,818,027 | A | 4/1989 | Simon | |

(Continued)

FOREIGN PATENT DOCUMENTS

| | | |
|---|---|---|
| DE | 102011079115 | 1/2013 |
| DE | 102015121953 | 7/2016 |

(Continued)

*Primary Examiner* — David J Bagnell
*Assistant Examiner* — Michael A Goodwin
(74) *Attorney, Agent, or Firm* — Mercedes V. O'Connor; James N. Videbeck; Rockman Videbeck & O'Connor

(57) ABSTRACT

An improved diamond coated tip on a bit/holder for road milling operations has a broadened base that provides cutting overlap with adjacent bit/holders resulting in a micro milling type surface when utilizing a regular ⅝ inch center-to-center drum.

14 Claims, 5 Drawing Sheets

(56) References Cited

U.S. PATENT DOCUMENTS 4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A * 11/1992 Burkett ..... E21B 10/567 299/111
5,219,209 A * 6/1993 Prizzi ..... E21C 35/183 299/111
5,273,343 A 12/1993 Ojanen
5,287,937 A 2/1994 Sollami
5,302,005 A 4/1994 O'Neill
5,303,984 A 4/1994 Ojanen
5,370,448 A 12/1994 Sterwert, Jr.
5,374,111 A 12/1994 Den Besten
5,415,462 A 5/1995 Massa
5,417,475 A 5/1995 Graham et al.
5,458,210 A 10/1995 Sollami
5,492,188 A 2/1996 Smith et al.
5,607,206 A 3/1997 Siddle
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,196,340 B1 * 3/2001 Jensen ..... E21B 10/52 175/431
6,199,451 B1 * 3/2001 Sollami ..... E21B 10/56 175/426
6,250,535 B1 6/2001 Sollami
6,331,035 B1 12/2001 Montgomery, Jr.
6,357,832 B1 3/2002 Sollami
6,371,567 B1 4/2002 Sollami
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 * 5/2004 Sollami ..... B28D 1/188 125/36
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,986,552 B1 * 1/2006 Sollami ..... B28D 1/188 299/104
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 5/2015 Sollami
9,316,061 B2 4/2016 Hall
2002/0074850 A1 6/2002 Montgomery
2002/0074851 A1 6/2002 Montgomery
2002/0167216 A1 11/2002 Sollami
2003/0011236 A1 * 1/2003 Sollami ..... E21C 35/183 299/111
2003/0015907 A1 1/2003 Sollami
2003/0052530 A1 * 3/2003 Sollami ..... B28D 1/188 299/111
2004/0004389 A1 1/2004 Latham
2006/0071538 A1 4/2006 Sollami
2006/0186724 A1 8/2006 Stehney
2008/0190666 A1 * 8/2008 Gatell ..... E21B 10/52 175/57
2009/0146491 A1 * 6/2009 Fader ..... B28D 1/186 299/105
2009/0261646 A1 10/2009 Ritchie et al.

(56) References Cited

U.S. PATENT DOCUMENTS

2010/0244545 A1* 9/2010 Hall ..... E21C 35/183 299/105
2010/0253130 A1 10/2010 Sollami
2011/0006588 A1 1/2011 Monyak et al.
2011/0089747 A1 4/2011 Helsel
2011/0175430 A1* 7/2011 Heiderich ..... B23P 11/027 299/105
2011/0204703 A1 8/2011 Sollami
2011/0254350 A1 10/2011 Hall
2012/0027514 A1 2/2012 Hall
2012/0038203 A1 2/2012 Hall
2012/0056465 A1* 3/2012 Gerer ..... E21C 35/183 299/29
2012/0068527 A1 3/2012 Erdmann
2012/0181845 A1 7/2012 Sollami
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2014/0326516 A1 11/2014 Haugvaldstad
2015/0028656 A1 1/2015 Sollami
2015/0137579 A1* 5/2015 Lachmann ..... B28D 1/188 299/10
2015/0240634 A1 8/2015 Sollami
2015/0285074 A1 10/2015 Sollami
2015/0292325 A1 10/2015 Sollami
2015/0300166 A1 10/2015 Ries et al.
2015/0315910 A1 11/2015 Sollami
2015/0354285 A1 12/2015 Hall
2016/0194956 A1 7/2016 Sollami
2017/0089198 A1 3/2017 Sollami

FOREIGN PATENT DOCUMENTS

DE 102016118658 3/2017
EP 2053198 A1 * 4/2009 ..... E21B 10/5673
GB 2483157 2/2012
WO 2008105915 A2 9/2008
WO 2008105915 A3 9/2008
WO 2009006612 1/2009

* cited by examiner

BIT/HOLDER WITH ENLARGED BALLISTIC TIP INSERT

This invention claims priority of provisional application Ser. No. 61/974,064 filed Apr. 2, 2014, the contents of which are incorporated herein by reference.

This invention relates to improved bit/bit holder combinations and, more particularly, to such a combination utilizing a larger PCD diamond layered ballistic tip insert.

BACKGROUND OF THE INVENTION

As basic infrastructure created in the 20th Century ages and wears, machinery for rejuvenating or replacing that infrastructure has become more important. While mining and trenching operation machinery may be included in this technology, road milling machinery is, thus far, the most prolific use of the instant machinery.

Road milling equipment utilizes a rotating drum having a plurality of bit assemblies removably mounted on the outside of the drum in spiral or chevron orientation. A typical rotating drum has a bit tip to bit tip diameter of between 44 and 54 inches and includes a plurality of mounting blocks generally secured thereto by welding in spiral or chevron patterns. The patterns noted provide for the bit blocks to be mounted behind and slightly axially to the side of one another such that the bits or combination bit/holders mounted in each bit block may have the tips of the bits positioned in close proximate relation along the axial length of the drum. As such, adjacent bit tips may be positioned anywhere from about 0.200 inch to about ⅝ inch axially apart for either removing concrete, asphalt, or the like, when replacing one or both of the pavement and underlayment for roadways, or may be positioned axially closer together, about 0.200 inch, for micro milling the surface of pavement to remove buckles, create grooves on curved surfaces such as cloverleafs, or the like.

Improvements in the bits and bit/holders that are removably mounted on the bit blocks have increased the useful in-service life of those removable parts. While such bit and bit/holders have been made of steel and hardened materials such as tungsten carbide, the use of diamond coated tips and man-made PCD (polycrystalline diamond) tips, has been shown to increase the in-service life of those bits and bit/holders.

Another improvement in bit/holders has been the invention of quick change holders that have eliminated the necessity of securing such holders with threaded nuts or retaining clips and have utilized the compressive elastic ductility of hardened steel to provide sufficient radial force between the holders and the bit block bores to retain holders mounted in their respective bit block bores during operation. While such bit assemblies have included rotatable and removable bits mounted in bit holders which, in turn, were mounted in bit blocks as noted above, the introduction of diamond materials on bit tips and their increased in-service life has, in some cases, allowed for the combining of bits and bit holders into a unitary construction with the tips no longer being rotatable on the holders.

A need has developed for improved structure at the front leading end or tip end of bit/holders that provide for improved wear characteristics, in-service life and finer milled road surfaces at reduced total cost.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENTS

The diameter of the base of the PCD ballistic insert is determined by the required geometric profile of the forward end of the point attack tool. As the machine or equipment size diminishes, so does the amount of horsepower of the engine or the machine needed to operate the machine.

The ballistic or parabolic style profile of the tip of the PCD insert provides a longer conic tip than a standard straight line side profile of a frustoconical tip. The longer parabolic tip has a greater PCD coated length with more structural strength. The included angle of the tip varies axially. Sollami PCD tool is 180 degrees rotatable to achieve extended life over prior art diamond coated tools, while maintaining nearly exactly the same cut surface profile.

Figure 1:
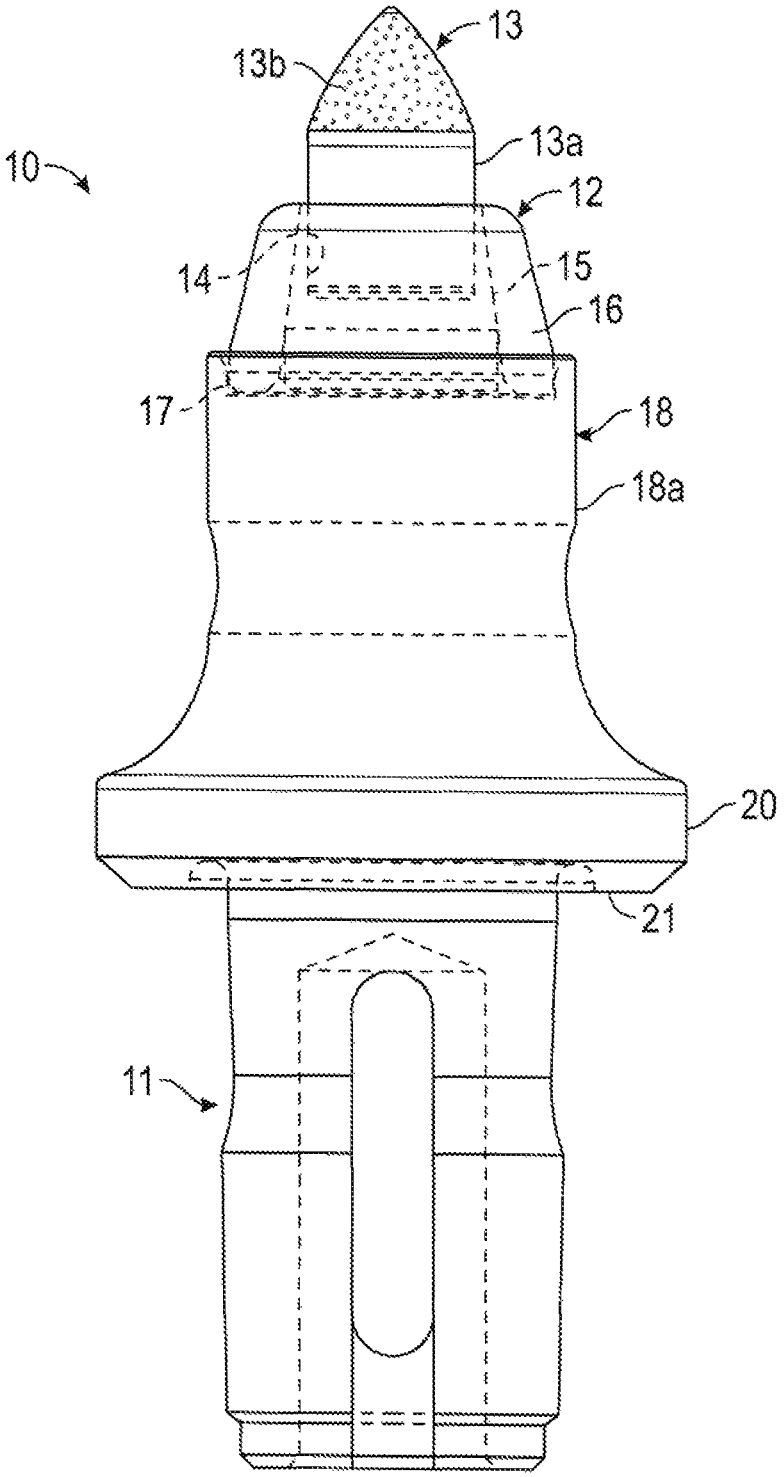
FIG. 1 is a front elevational view of a bit/holder constructed in accordance with the present invention including an improved and enlarged leading tip section.

Referring to FIGS. 1 and 2, a bit/holder 10, constructed in accordance with the present invention, includes features from this inventor's previous U.S. Pat. Nos. 6,371,567, 6,585,326 and 6,739,327 which show both the shank 11 at the rear of the bit/holder, and the tip portion 12 having a diamond coated tungsten carbide tip insert 13 mounted in a generally cylindrical recess at the center of an annular flange 15 extending axially outwardly from the steel body portion of the bit/holder. This steel annular flange 15 provides ductility and shock absorption characteristics to the generally ballistic shape tip 13 that is preferably made of tungsten carbide having either a single 13*b* or multiple layer (See FIG. 6) of industrial diamond or PCD superstructure over the forward conical portion of the tip. Additionally, an annular ring 16 of tungsten carbide is mounted over the steel annular flange 15 for added wear resistance to the aft portion of holder. The tungsten carbide annular ring 16 is preferably brazed in an annular groove 17 at the top of the body portion 18 of the holder 10.

In the preferred embodiment of the bit/holder 10 when used for road milling purposes, the nominal outer diameter of the shank 11 is about 1.5 inches and the nominal outer diameter of the widest portion of the body 18 of the holder is about 2⅝ inches at what is termed the "tire portion" 20 of the holder body 18. The diameter of the upper cylindrical portion 18*a* of the body 18 is about 1¾ inches and the axial length of the body from the rear annular flange 21 to the front of the cylindrical portion is about 3 inches. The length of the shank 11 in the embodiments shown approximates 2½ inches. As taught in my patent application Ser. No. 61/944,676, filed Feb. 26, 2014, now utility application Ser. No. 14/628,482, filed Feb. 23, 2015, and now U.S. Patent Application Publication 2015/0240634, published Aug. 27, 2015, the contents of which are incorporated by reference, bit holder shanks may be shorter, on the order of 1½ inches.

With the forward cylindrical end of a bit holder body 18 having a diameter of about 1¾ inches, prior art bits or pick bolsters have been designed to have a conical surface aiding in diverting pavement material away from the forward tip portion of the bit/holder or bit.

In designing these structures, tip inserts having a front conical tip of PCD or diamond layered material 13*b*, as shown in FIG. 1, have been selected to provide the best results. The diamond of the tip insert at its widest point for holders seized as above has thus far been a tip insert made to a base diameter of about 0.565 inch. In experimenting with such diamond covered tip insert structures, applicant has discovered that using such a tip having a nominal diameter of 0.625, 0.75, 0.875 inch or larger ballistic tip insert may still be inserted in a modified structure substantially similar to that previously shown in Patent '327. Thus, the improvement is also compatible with existing drums and bit holder blocks. This preferred ¾ inch or larger diameter ballistic shaped tip insert 40 is also longer (See FIG. 6) in overall length than the 0.565 inch diameter prior insert utilized.

Figure 4:
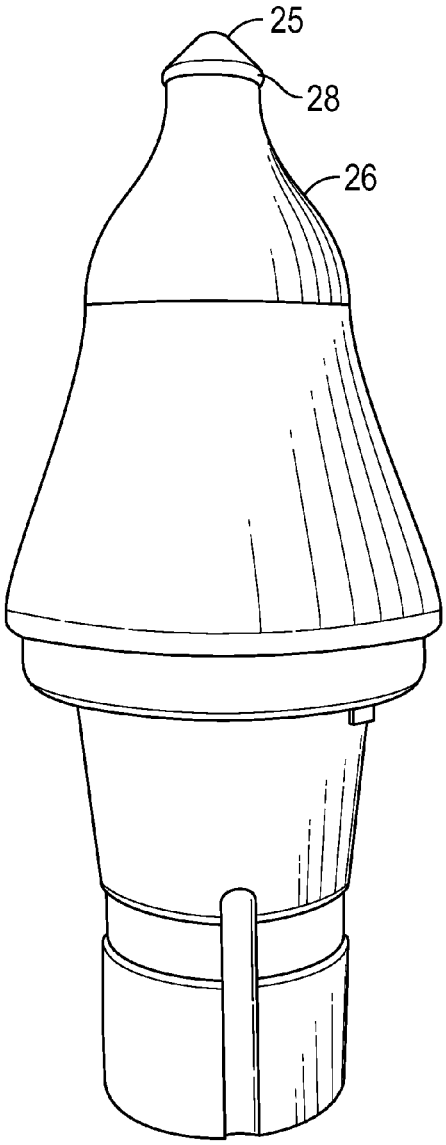
FIG. 4 (Prior Art)
FIG. 4 is a photograph showing a front elevational view of a prior art bit/holder after substantial in-service use showing the wear characteristics on it after substantial use.
Figure 5:
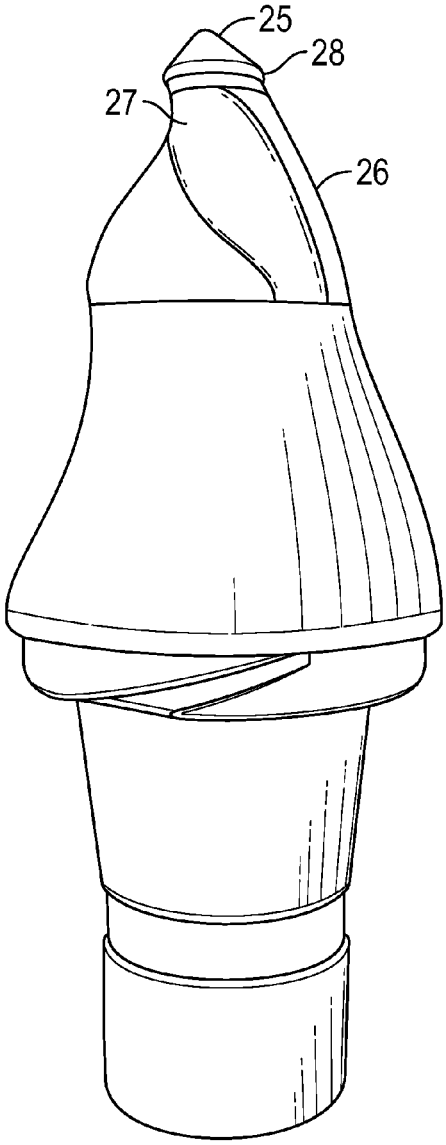
FIG. 5 (Prior Art)
FIG. 5 is a photograph showing a side elevational view of the prior art bit/holder shown in FIG. 4 wherein separated material has flowed past the left side of the bit/holder in use.

The overall length of the ¾ inch diameter ballistic tip insert is about 1.3 inches. This length when mounted in the cylindrical recess 17, having a diameter of at least 0.625 inch, at the front of the bit holder body 18 allows the ballistic tip insert 13 to extend at least ⅝ inch from the front of the annular tungsten carbide collar 16 and to extend at least ½ inch outwardly of recess 17. When coating tungsten carbide inserts with diamond, high temperature, high pressure presses are used. Making more 0.565 diameter inserts has thus far yielded slightly cheaper inserts, but applicant has found that making fewer, larger inserts per manufacturing operation at cycle yields better milling results, although each insert is made at a slightly higher cost. Referring to FIGS. 4 and 5, the wear pattern of a prior art PCD insert tip 25 attached to a tungsten carbide bolster bit/holder 26 of prior art 0.565 inch tip diameter is shown. The conical portion of the ballistic tip insert 25 shows some wear after substantial use of the tool. Most of the wear occurs immediately aft 27 of the widest part 28 of the tip insert. This wear occurs in the product shown on both sides in FIG. 4 and on the left (loosened material flow side in FIG. 5) in what is termed a "tungsten carbide bolster" 28 that initially is generally frustoconical in shape with a slightly convex worn outer surface. The right side of the tip 25 in FIG. 5 slides along the remaining roadway material. As shown in FIGS. 4 and 5, this PCD conical front tip 25 extends minimally away from the front of the tungsten carbide bolster 26. It is submitted that the additional ⅝ inch extension of the improved ¾ inch or larger diameter ballistic tip insert of the present invention urges removed asphalt and concrete material away from the tip 13 at the area of most wear (the left side of FIG. 5 in the prior art) and thus provides reduced wear on the annular ring.

Figure 2A:
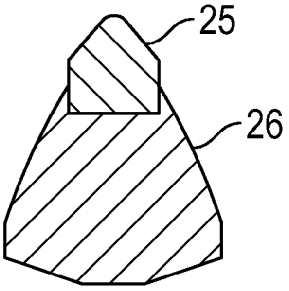
FIG. 2A (Prior Art)
FIG. 2*a* is a cross section view of a prior art 0.565 PCD tip insert mounted on a recess in a pick bolster.
Figure 2B:
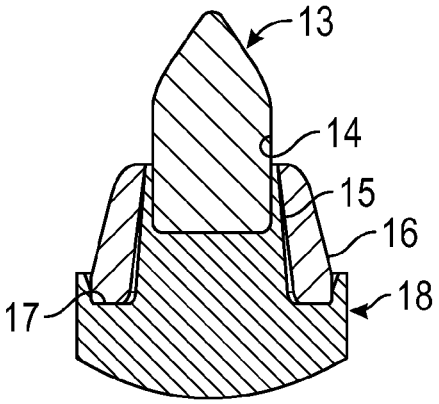
FIG. 2*b* is a fragmentary cross section view of the 0.75 inch diameter PCD layered tip insert as in FIG. 1 shown for comparison purposes with the prior art disclosed on the other FIG. 2 drawings.

Referring to FIGS. 2*a*, 2*b*, 2*c* and 2*d*, the bit tip insert of the invention shown in FIG. 2*b* is compared with prior art 0.565 inch diameter conical tips shown in FIG. 2*a*. The added diamond coated conical area of the new tip 2*b*, shown in FIG. 2*c* solid line 13 at the sides of the prior art tip 2*a* at 25 provides substantially greater diamond protected cutting area than the prior art. This added area, when used on neighboring like sized tips, on ⅝ inch center-to-center drums, provides substantial cutting overlap on pavement to be milled.

Figure 2C:
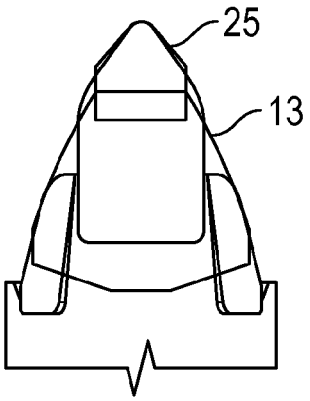
FIG. 2*c* is a diagram view showing the prior art tip of FIG. 2*a* superimposed on the front portion of the enlarged tip of FIG. 2*b;*
Figure 2D:
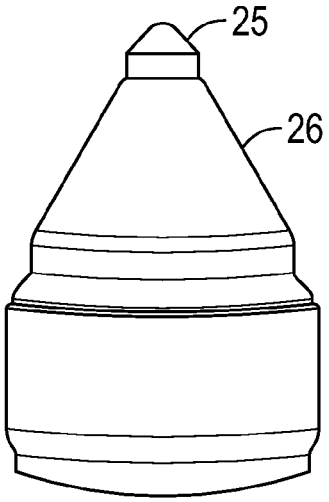
FIG. 2D (Prior Art)
FIG. 2*d* is a fragmentary photograph of another prior art tip having a 0.565 diameter conical distal end.

FIGS. 2*a* and 2*d* show prior art 0.540 to 0.565 inch PCD inserts 25 which have conical PCD tips brazed to tungsten carbide bases mounted on a pick bolster 26 made of tungsten carbide.

FIG. 2*c* shows the outlines of tip insert of the present invention 13 as mounted in a bit holder with the prior art 0.565 tip and bolster of FIG. 2*a* superimposed at 25 thereon. As in FIG. 2*b*, the added (enlarged) diamond coated conical portion over this piece of prior art can readily be seen with similar advantages as discussed above. The profiles toward the top of the bit insert are similar, but the height of the tapered portion is greater than a 0.565 inch PCD tip producing better wear protection to the annular carbide ring as will be discussed below.

FIG. 2*d* is a photograph of another prior art 0.565 diamond tip insert 25. Applicant's 0.75 inch conical tip insert would provide similar advantages over this tip as mentioned in connection with FIG. 2*c* above.

Figure 3:
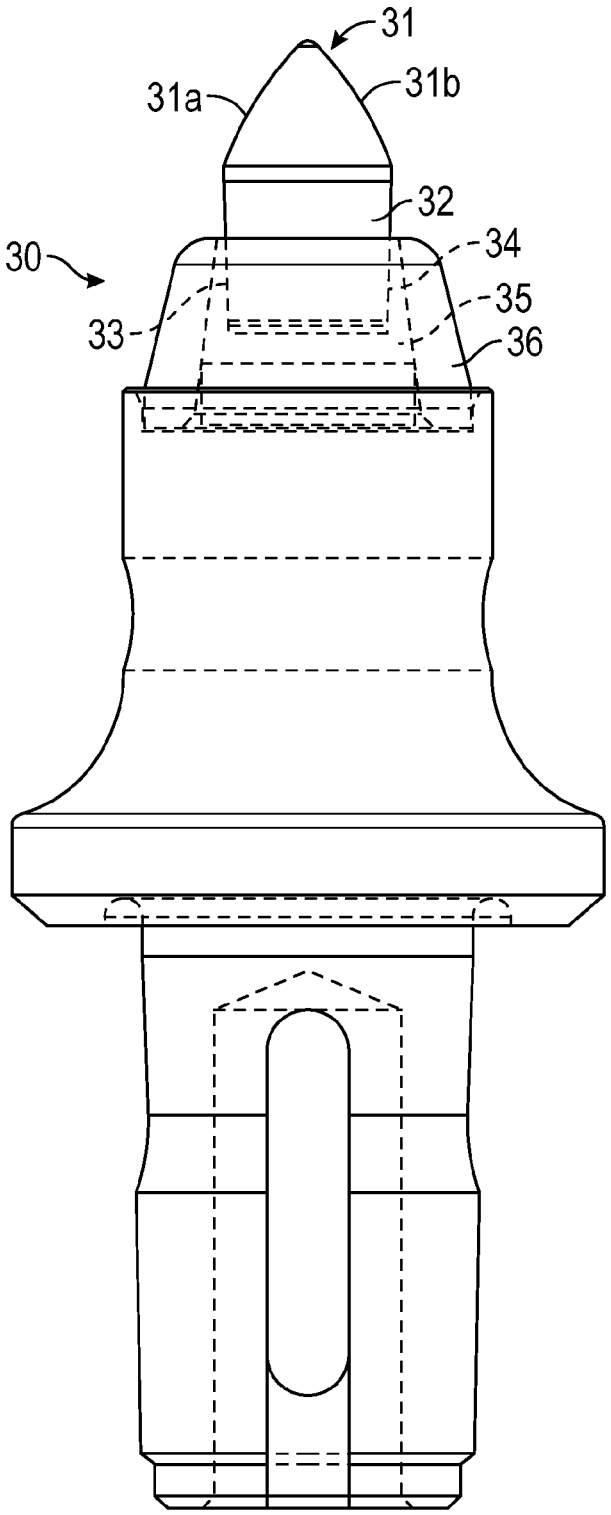
FIG. 3 is a front elevational view of a second embodiment of invention showing a tip having a slight reverse taper in the aft or body portion thereof which is mounted on the front of the holder portion thereof.

FIG. 3 shows a second embodiment of the present invention 30 utilizing a 0.75 inch nominal diameter diamond covered conical tip 31 with a tungsten carbide base 32 that is slightly reverse tapered at its sides 33, 34 at approximately a 2 degree half angle, that is, 2 degrees per side.

While prior art bits and bit/holders disclose an enlarged tungsten carbide conical portion just aft of the 0.565 inch base insert with PCD shaped tip, the present invention, having a steel annular tubular column 35 into which the 0.75 diameter PCD insert is inserted, provides additional shock absorbing characteristics as a result of the ductility of the steel. Prior art PCD tungsten carbide inserts brazed to tungsten carbide bases do not possess those shock absorbing capabilities because of the brittleness of the tungsten carbide. The central steel annular tubular column 35 also provides for greater thermal expansion and contraction during use. As the forward end of the PCD insert 31 increases its working temperature, the steel column 35 will expand twice the amount of tungsten carbide expansion for the same increase in temperature and grab the PCD insert 31 more securely. The carbide collar 36 prevents the steel column 35 from expanding outwardly. The steel tubular column 35 expands about twice the expansion coefficient rate as tungsten carbide. The steel elongation values exceed 30 percent before taking a permanent set showing substantial ductility.

Thus, improved bit/holders, 10, 30, utilizing a ballistic shape tip of an increased diameter from 0.565 inch to 0.75 inch and larger provides a superior product than previously known in the art while still being usable with present size bit holder blocks (not shown).

Figure 6:
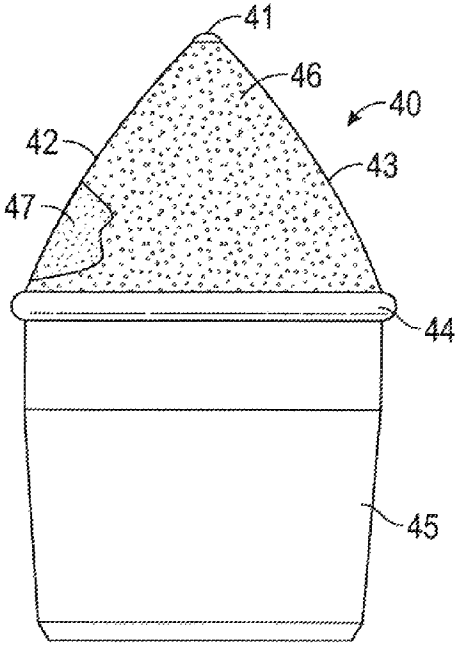
FIG. 6 is an enlarged diagrammatic elevational detail view of a third embodiment of the enlarged tip insert.

Referring to FIG. 6, a third embodiment of a ballistic shaped diamond coated tungsten carbide insert is shown at 40. A tip such as shown in the first embodiment could include a frustoconical tip having an approximately ⅛ inch curved radius at the top 41 thereof, and straight or parabolic conical sides leading down to the widest part of the base 44. Also, the tip shown in the first embodiment 13 has a cylindrical base 13*a* that extends at least about ¾ inch behind the generally conical tip 13, which fits into the cylindrical recess 14 at the top of the body 18 of the holder 10 in the first embodiment and is brazed into recess 14.

In the second embodiment 30, the tip 31 shown in FIG. 3 and the third embodiment 40 of FIG. 6 also include an approximate ⅛ inch curved top. The sides 31*a*, 31*b* of the conical portion of the insert are parabolic in shape starting out with about a nominal 84 degree separation adjacent the curved top thereof and after a ⅛ inch length, changing to an approximate 70½ inch separation. An additional ⅛ inch thereafter, the parabola shape changes to a 60½ degree separation and another ⅛ inch down from there the separation changes to an approximate 51 degree separation.

The parabolic shape of the ballistic tip 31 provides more mass under the multi layered diamond coating than would a straight side conical tip. Additionally, the top of the parabolic tip 31 provides improved separation of the material removed from the base thereof and directs the material removed further away from the base of the tip.

As shown, the base 32 of the tip 31 in the second embodiment is ¾ inch in diameter and in the second embodiment includes a 2 degree per side taper toward the bottom of the insert which is a total 1 inch in height.

As mentioned previously, it appears from the drawing shown in FIG. 3, that an important factor for wear in the bit/holder is the width of the base of the tip in the insert. While prior art inserts have been approximately 0.565 inch in diameter, increasing that diameter to 0.75 inch and more provides a wider base at the point of greatest wear during use of such a bit/insert. Thus the use of a 0.75 inch or greater diameter insert base provides for greater longevity of use. Also, larger bit holders are utilized for trenching and mining operations, so larger bit inserts can be utilized there. Further, the increased length of the insert to 1 inch in length allows a ⅝ inch exposed length of the insert that also directs material removed away from the base of the insert to decrease the wear in what FIGS. 4 and 5 shows as the most sensitive part of the wear for a bit/holder during use.

The third embodiment of the diamond coated tip 40 shown in FIG. 6 differs from that shown in FIG. 3 in that the diamond coating 46 includes a ridge or overfill portion 44 at the base of the parabolic curves 42, 43 that has a thickness of about 0.030 inch per side. The overfill or over molded portion 44 may not be regular in shape and does not need to be ground or removed into any specific shape. This added diameter also affects the shape of the finished surface as will be discussed in more detail below. Depending upon the grade of diamond material or PCD material used, this thickness of the diamond coating may typically be about 0.120 inch or less. Multiple layers of diamond coating 46, 47, as shown in FIG. 6, may be deposited on the bit tip 40. It should be noted that with the greater diameter and outward 44 extending diamond edge overfill of the increased tip 40 shown in FIG. 6, a thinner diamond or PCD coating at 46, 47 may be utilized in adjusting wear characteristics vs. cost. It should be noted that the conical area of a 0.75 inch diameter cone at the tip includes over 3.5 times the area of a 0.565 inch tip, providing a substantially more massive cooling tool.

Figure 7:
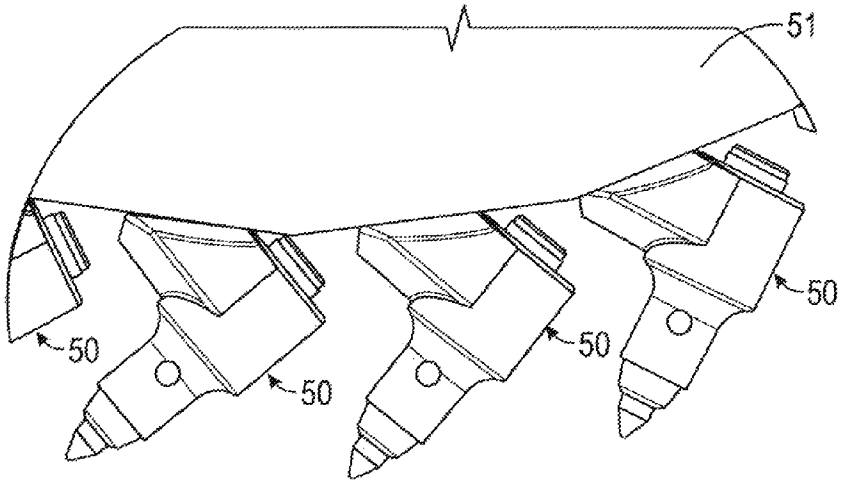
FIG. 7 is a diagrammatic stop motion side view of the partial sweep of a bit assembly as it moves through its material separating operation.
Figure 8:
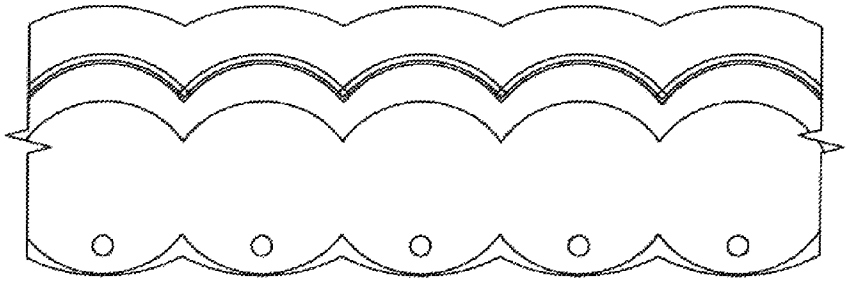
FIG. 8 is a diagrammatic front view taken at 90 degrees to FIG. 7 showing the added side overlap of successive bit assemblies resulting in a finer finish cut using a drum with standard 0.625 inch center-to-center tip spacing.

Referring to FIGS. 7 and 8, a plurality of cutting tools 50-50, constructed in accordance with the present invention, are shown sweeping across the cutting area of a surface to be removed. As previously described, the increased outer diameter of the bit tip to 0.75 inch adds mass to the exact area where most wear during use occurs. This increased cross section creates a shallow depth pattern as needed in micro milling, without requiring additional machine horsepower.

As previously discussed, a plurality of these bit assemblies 50-50 are mounted on cylindrical drum 51 in spiral or chevron fashion. A typical drum being 7 feet 2 inches in length and typically 44 to 54 inches in diameter, may hold around 168 bit assemblies with center-to-center axial spacing of 0.625 inch between bit assemblies. This is in what is termed a "standard drum" previously used for removal of not only surface material, but also substrate material. Previously, drums used for micro milling have had center-to-center tip axial spacing of 0.20 inch between tips. As such, drums used for micro milling may have over 325 bit assemblies for same 7 feet 2 inch length drum. This is in drums term "double or triple hit drums," double hit drums may have 50 percent more of the bit assemblies. Full lane micro milling drums that are 12 feet, 6 inches in length may have 650 to 900 bit assemblies per drum at a 0.200 inch center-to-center axial tip spacing.

Applicant has found that the use of ¾ inch nominal diameter or larger diamond coated bit tips when used at ½ to 1 inch depth of cut at approximately 92 rpm drum rotation speed and at a travelling speed of 20 ft/min may provide a surface approaching or equal to the flatness of a micro milled surface previously obtained with 0.565 inch diameter bit tips on drums having 0.200 inch center-to-center bit separation with same machine cutting specifications.

FIG. 8 shows a diagram of succeeding 0.75 inch bit tips of the invention spaced at 0.625 inch apart which gives an axial overlap between adjacent bit tips of 0.155 inch. This overlap is also at the point of most vertical curvature of the cut, leaving a substantially flatter surface than would be obtained using the 0.565 inch diameter bit tips. The fineness of the residual surface is also obtained by moving the drum at a slower speed (15-25 fpm). The faster in feet per minute the drum travels forward, the rougher the cut. It is therefore necessary not to outrun the cut. A speed of 40-80 feet per minute is considered normal for a rough cut.

As noted, the resulting fineness of the surface milled using the larger diameter bit tip approaches or achieves micro milling flatness by utilizing standard center-to-center diameter drums instead of the more expensive drums presently made for micro milling operations. Additional fineness of cut can be achieved by modifying spacing to somewhat less than 0.625, but substantially greater than 0.2 inch center-to-center. Not only is the cost of the drum less, but utilizing fewer bit assemblies makes a lighter drum requiring less horsepower to operate.

While three embodiments have been shown and described, it will be understood by those skilled in the art that many changes and modifications may be made without departing from the true spirit and scope of the present invention. It is the intent of the appended claims to cover all such changes and modifications which fall within the true spirit and scope of the invention.

What is claimed:

1. A bit holder comprising, a body and a shank extending centrally axially from said body, said body including a cylindrical recess adjacent a distal end thereof, said recess having a diameter of between five eighths and seven eighths inch, a diamond coated bit tip insert disposed in the recess, the bit tip insert having a diameter at its widest part greater than five eighths inch, and wherein said diamond coated bit tip insert includes an overfill portion extending outwardly of a widest portion of the diamond coated bit tip insert.

2. The bit holder as defined in claim 1 including a base of said diamond coated bit tip insert centrally axially behind a generally conical tip thereof that extends outwardly of said recess in said body at least ½ inch.

3. The bit holder as defined in claim 1 wherein said diamond coating consists of a single layer of polycrystalline diamond.

4. The bit holder as defined in claim 1 wherein said diamond coating includes multiple layers of diamond material.

5. The bit holder as defined in claim 1 wherein said bit tip insert includes a generally conical top portion including a parabolic curved section below an apex thereof.

6. The bit holder as defined in claim 1 wherein a base of said bit tip insert is cylindrical.

7. The bit holder as defined in claim 1 wherein a base of said bit tip insert is tapered inwardly toward a bottom of said base.

8. A diamond coated bit tip insert comprising: a body having a diameter greater than five eighths inch at a widest part, said diamond coated bit tip insert includes an overfill portion extending outwardly of a widest portion of the diamond coated bit tip insert.

9. The diamond coated bit tip insert as defined in claim 8 wherein a base of said diamond coated bit tip insert centrally axially behind a generally conical tip extends at least three quarters inch from said generally conical tip.

10. The diamond coated bit tip insert as defined in claim 8 further comprises a diamond coating that includes a single layer of polycrystalline diamond.

11. The diamond coated bit tip insert as defined in claim 8 further comprises a diamond coating that includes a plurality of layers of diamond material.

12. The diamond coated bit tip insert as defined in claim 8 wherein said bit tip insert includes a generally conical top portion including a parabolic curved section below an apex thereof.

13. The diamond coated bit tip insert as defined in claim 8 wherein a base of said bit tip insert is cylindrical.

14. The diamond coated bit tip insert as defined in claim 8 wherein a base of said bit tip insert is tapered inwardly toward a bottom of said base.

* * * * *